United States Patent [19]

Lemelson

[11] 4,169,303

[45] Oct. 2, 1979

[54] FASTENING MATERIALS

[76] Inventor: Jerome H. Lemelson, 85 Rector St., Metuchen, N.J. 08840

[21] Appl. No.: 744,504

[22] Filed: Nov. 24, 1976

[51] Int. Cl.[2] ..... A44B 13/00

[52] U.S. Cl. ..... 24/204; 428/62

[58] Field of Search ..... 24/204, 205.13 D, 205.12; 428/100, 62, 58

[56] References Cited

U.S. PATENT DOCUMENTS

| | | | |
|---|---|---|---|
| 2,772,469 | 12/1956 | Staller | 24/204 |
| 2,800,743 | 7/1957 | Meehan | 24/204 |
| 3,128,514 | 4/1964 | Parker | 24/204 |
| 3,266,113 | 8/1966 | Flanagan | 24/204 |
| 3,312,583 | 4/1967 | Rochlis | 24/204 |
| 3,314,119 | 4/1967 | Hill | 24/204 |
| 3,403,429 | 10/1968 | Smith | 24/201 C |
| 3,546,754 | 12/1970 | Erb | 24/204 |
| 3,808,646 | 5/1974 | Brumlik | 24/204 |
| 3,905,071 | 9/1975 | Brumlik | 24/204 |
| 3,955,246 | 5/1976 | Tanaka | 24/204 |

*Primary Examiner*—Bernard A. Gelak

[57] ABSTRACT

Structures are provided in strip or sheet-like fastening materials formed by molding together with an apparatus and method for producing same. In one form, a strip-like fastening material is formed by molding a plurality of narrow strips, each containing at least one row of fastening elements extending longitudinally therealong and guiding said strips into edgewise abutment whereafter they are fastened together, such as by welding, to form a wider strip or sheet of fastening material containing a plurality of rows of molded fastening elements. The fastening elements may comprise molded hooks with or without barbs, arrowhead formations, mushroom-like formations, loops of plastic or otherwise formed formations which may intermesh with the same or different formations of another strip to effect the fastening of the two strips together. In a particular form, hook or barb-shaped elements are formed along respective strips of metal or plastic by stamping or molding and the strips are hingedly joined together.

9 Claims, 20 Drawing Figures

FASTENING MATERIALS

SUMMARY OF THE INVENTION

This invention relates to improvements in strip-like fastening materials formed by molding or stamping separate narrow strips wherein each of the narrow strips are joined together to form wider strip-like formations having a plurality of rows of fastening elements protruding outwardly from either or both surfaces thereof.

It is known in the art to produce strip-like fastening materials containing filamentary elements protruding outwardly from a surface thereof in the configurations of hook-like configurations which are formed when loop-like formations are secured to base strips and are laterally cut by a cutting means to form the hook-like formations. Such materials are relatively costly due to the fact that the formation thereof is a relatively slow process and requires a number of separate steps including a step of forming a base sheet of textile material or plastic, a second step of forming a plurality of filamentary plastic elements into wave-like or sinusoidal formations, a third step of securing the sinusoidal formations to the base strip and a fourth step of controllably cutting the sinusoidal formations to form multiple rows of hook-like formations thereof. Such materials are known by the trade name Velcro and suffer other shortcomings in addition to the relatively high cost to manufacture.

The instant invention is drawn to improvements in sheet-like fastening materials which may be rapidly produced at low cost and may be made into configurations in which the conventional strip-like fastening materials cannot be made. Such configurations lend the fastening materials to applications which are not possible utilizing the conventional Velcro hook and loop materials. The configurations are produced by injection molding or compression molding a plurality of plastic strips with suitable irregular formations, such as hooks or loops, protruding laterally from an edge of the strips and thereafter guiding the strips so that their edge portions abut each other along the lengths of the strips in which condition they may be edgewise welded together to form a wider strip or sheet-like formation defined by a plurality of rows of filament-like fastening elements which may be engaged by a similar or mating material formed of a multitude of fastening elements which engage the fastening elements thereof and retain the two materials together.

Accordingly it is a primary object of this invention to provide new and improved structures in multiple element fastening materials.

Another object is to provide a new and improved multiple element fastening material which may be formed by molding the elements to shape in a plurality of separate substrates which are thereafter joined together to form a fastening material over an extended area of a substrate.

Another object is to provide a multiple element fastening material which may be formed by injection molding.

Another object is to provide a multiple element fastening material which may be formed by compression molding.

Another object is to provide a multiple element fastening material formed by molding and containing a multitude of barb-like formations protruding from a surface thereof.

Another object is to provide a multiple element fastening material containing a multitude of loop-like formations molded in and protruding from a surface thereof.

Another object is to provide a multiple element fastening material formed of a plurality of strips of metal or plastic which are edgewise hingedly joined together.

Another object is to provide an apparatus and method for producing multiple element fastening materials.

With the above and such other objects in view as may hereafter more fully appear, the invention consists of the novel constructions, combinations and arrangements of parts as will be more fully described and illustrated in the accompanying drawings, but it is to be understood that changes, variations, and modifications may be resorted to which fall within the scope of the invention as claimed.

Figure 1:
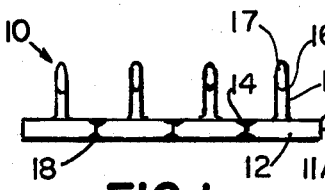
FIG. 1 is an end view of a portion of a multiple element fastening material formed of a plurality of strips of plastic each containing a single row of hook-like fastening elements molded integral with the strip and protruding upwardly from a face of the strip wherein each of the strips are edgewise welded to adjacent strips along its length.
Figure 3:
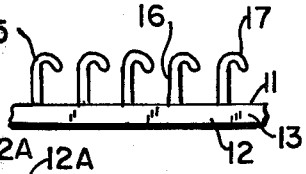
FIG. 3 is a side view of a portion of one of the strips of fastening elements of FIG. 1.

In FIG. 1 is shown an assembly 10 of a plurality of separate moldings 11, each in the form of a molded strip containing a strip-like base 12 having a plurality of hook-like formations 15 extending upwardly from the upper surface of the base 12 and spaced close to each other in a row as illustrated in FIG. 3. Each of the hook-like elements 15 is composed of an upstanding filament-like formation 16 which is formed at its upper end in the configuration of a shallow U-shaped formation or hook-like formation 17.

Figure 2:
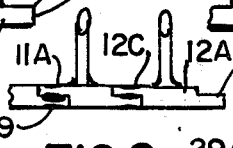
FIG. 2 is an end view of a portion of a modified form of the fastening material of FIG. 1 wherein the edge portions of the strip-like elements are stepped to facilitate their fastening together.

By means of apparatus of the types disclosed in my application filed herewith for a Manufacturing Apparatus and Method, respective lengths of each of the strip-like elements 11 may be simultaneously compression molded from respective strip-like formations of thermoplastic resin, such as respective extrusions thereof, and fed in parallel array with the other strip-like moldings to cause the lateral side edges or surfaces 13 and 14 of the strip-like base formations 12 of each element 11 to abut the sides of respective adjacent, similarly shaped strip-like moldings, or to overlap same as illustrated, for example in FIG. 2, so that the abutting or overlapping edge portions of each molding may be heat sealed, electronically fusion welded or adhesively bonded together in a special automatic and continuous fixture. The result is a fastening material, such as illustrated in FIG. 1, which is composed of a plurality of the molded strips 11 which are edge welded or otherwise sealed together along welding or sealing lines 18 across the abutting surfaces to form a unitary sheet-like base containing a plurality of rows of the fastening hook-like formations 15.

In FIG. 2, the flat hook-like base elements, denoted 12A, have been modified so that each contains respective stepped formations 12B and 12C along the opposite longitudinal edges thereof which overlap the edge formations of the adjacent strips permitting the horizontal overlapped interfaces between the edge portions of the adjacent molded formations to be welded together as denoted by respective fusion welding or bonding lines 19.

Figure 4:
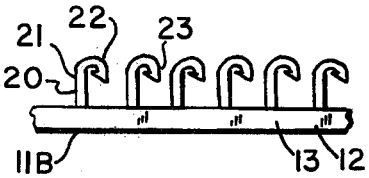
FIG. 4 is a side view of a portion of a strip-like fastening material of the type provided in FIGS. 1-3 but having the fastening elements thereof containing a first form of barb formation at the ends thereof.

In FIG. 4 each of the strip-like moldings 11B contain a plurality of hook-like filamentary formations 20 each having an upstanding shank portion 21 which is molded to the base strip 12, a U-shaped head portion 22, the end portion 23 of which is molded in the configuration of a hook having a sharp barb-like formation to permit it to be engaged within the loops of a suitable textile material to which the fastening strip is to be secured.

Figure 5:
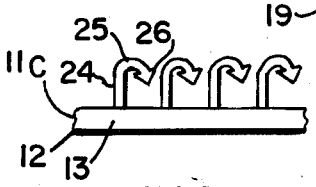
FIG 5 is a side view of a portion of a modified form of strip-like fastening element of the type shown in FIG. 4 wherein the barb-like formations protrude from both sides of the fastening elements.

In FIG. 5 a strip-like molding 11C contains a strip-like base 12 and a plurality of hook-like formations 24 molded integral with one surface of the base strip 12, each having a U-shaped portion near its upper end with the ends of the U-shaped portions containing respective arrowhead-like formations molded integral therewith.

Figure 6:
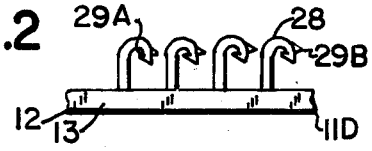
FIG. 6 is a side view of another modified form of strip-like fastening material showing a different type of barb-like formation molded integral with the end portions of the fastening elements.

In FIG. 6, the strip-like moldings 11D contain a plurality of upstanding hook-like formations 27 molded integral therewith and each containing a U-shaped head 28 with a plurality of barb-like formations 29A and 29B extending from opposite sides of the ends of the hook-like formations so as to better engage loop formations of the conventional pile material which is fastened to or retains an array of the strip-like formations 11D in edgewise abutment as illustrated in FIG. 1.

Figure 7:
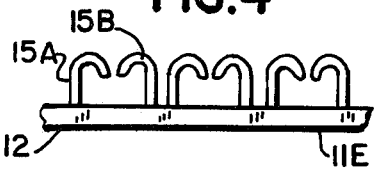
FIG. 7 is a side view of a portion of a strip-like fastening material showing molded hook-like formations which face each other along the length of the strip.

In FIG. 7, a plurality of closely adjacent pairs of hook-like formations 15A and 15B the ends of which protrude outwardly and downwardly toward each other, as illustrated. When secured to adjacent similar strip-like formations, as described, a wider strip-like formation or sheet having pairs of facing hook-like formations extending both longitudinally and laterally across the sheet is provided wherein adjacent hook-like formations may cooperate in fastening by engaging loops or hooks of another fastening material, of the type described hereafter or composed of a pile fabric, such as made of nylon filaments which extend outwardly from the fabric in a multitude of loop-like formations by brushing or tufting such material.

Figure 8:
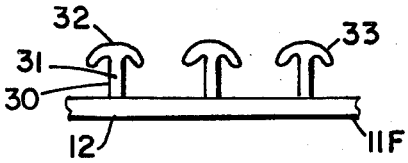
FIG. 8 is a side view of a portion of a modified form of fastening material in which the fastening elements have hook-like formations protruding from two sides thereof.

In FIG. 8 is shown a portion of a molded strip 11F containing a row of fastening elements 30 molded integral with the strip base 12 and each formed with an upstanding narrow filament-like shank 31 having a head 32 molded thereon which head contains a plurality of laterally extending hook-like formations 33, there being two of such hook-like formations for each fastening element 30 which extend outwardly and downwardly in opposite directions. The molded strip 11F may have the base strip portion 12 thereof butt or lap welded or otherwise bonded to similarly shaped adjacent strips as shown in FIG. 1.

Figure 9:
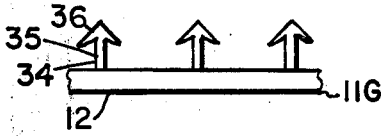
FIG. 9 is a side view of a portion of a modified strip-like fastening material having fastening elements with arrowhead formations integrally molded therewith.

In FIG. 9, a portion of a molded strip 11G is shown containing a row of fastening formations 34 molded integral therewith along the length of the base 12 of the strip and each formed with an upstanding filament-like shank 35 having an arrowhead-like formation 36 secured to and pointing upwardly from its upper end. While the elements 34 are shown spaced-apart on the base strip 12, they may, of course, be closer together than shown so that the barb-like, downwardly protruding side portions of the arrowheads may engage in closely spaced loop formations of a loop fastening material of the type described.

Figure 10:
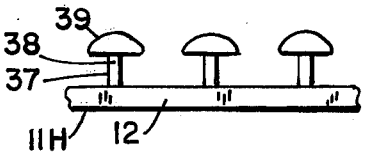
FIG. 10 is a side view of a portion of a strip-like fastening material having fastening elements containing molded mushroom head formations.

In FIG. 10, a portion of a molded fastening strip 11H is shown as having a row of fastening elements 37 integrally molded against and protruding upwardly from a strip-like base portion 12 of the type described and each formed with a narrow filament-like shank 38 at the upper end of which is molded a mushroom-type head formation which protrudes laterally around the shank. The mushroom head formations 39 may be adapted to engage in and be retained by filamentary loop formations of a cooperating fastening material of the type described or may be so spaced from each other that the lateral portions of each mushroom formation may engage between two, three or four lateral portions of adjacent mushroom formations of a mating fastening material of similar configuration and composed of such molded strips which are longitudinally welded or bonded together along the edge portions of the base formations 12 thereof.

Figure 11:
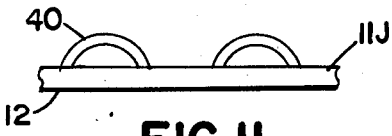
FIG. 11 is a side view of a portion of a modified strip-like fastening material having spaced-apart loop formations integrally molded and protruding from a face of the strip-like material.

In FIG. 11, is shown a portion of a molded fastening strip 11J formed with a strip-like base 12 containing a row of spaced-apart filament-like loop formations 40 molded integral therewith. Similar strips of the material 11 may be edge bonded or welded together with their loop-like formations 40 laterally aligned with each other or staggered across the resultant composite strip or sheet to serve as engagement means for the hook-like formations of hooking materials of the types illustrated in FIGS. 2–10. The loop-like formations 40 may have a variety of different configurations and may extend a greater or lesser degree from the upper surface of the base strip formation 12 than illustrated depending on the desired results. Such formations may be spaced closer together than illustrated in FIG. 11 as provided in FIG. 12.

Figure 12:
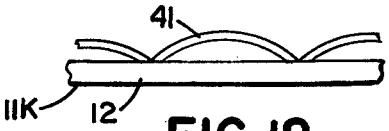
FIG. 12 is a side view of a portion of a modified form of fastening material having loop-like formations integrally molded with the strip and extending along the length thereof.

FIG. 12 shows a fastening strip material 11K formed of a base strip formation 12 of the type described and having a plurality of loop-like formations 41 of flexible, filament-like structure which are joined by molding to the upper surface of the base strip such that where one loop-like formation terminates, the next adjacent loop-like formation begins as illustrated. A plurality of molded strips 11K may be edge abutted together and welded or bonded in an assembly in which the loop-like formations of each strip extend in alignment with those of the other strips or staggered with respect to the other strips.

Figure 13:
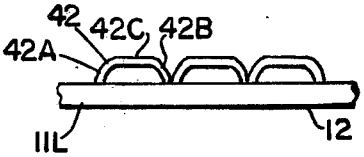
FIG. 13 is a side view of a portion of yet another configuration of loop-like fastening material which is a modified form of that shown in FIG. 12.

In FIG. 13, a molded strip 11L contains a plurality of loop-like formations 42, which are filament-like in structure and each of which contains downwardly curved end portions 42A and 42B joined by a central portion 42C which extends substantially parallel to the upper surface of the base strip-like formation 12. Parallel edge abutting arrays of the strips 11L may be welded or bonded together as described with the loop formations 42 arranged in lateral rows or staggered with respect to each other.

Figure 14:
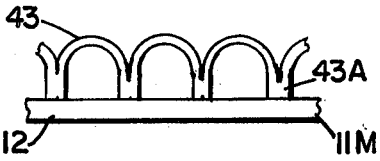
FIG. 14 is a side view of a portion of another form of loop-like fastening material wherein the loop-like formations are integrally molded with the strip material and protrude a substantial distance from a face thereof.

In FIG. 14, a fastening strip 11M is formed by molding a plastic resin of the type described in the shape of a continuous narrow base strip formation 12 containing a plurality of oblong, filament-like loop formations 43, each protruding upwardly from leg portions 43A which are molded at their lower ends to the upper surface of the strip-like base 12. Adjacent leg portions 43A of each oblong loop formation 43 extend either close to each other or from the same portion of the outwardly extending leg-like formations thereof.

Figure 15:
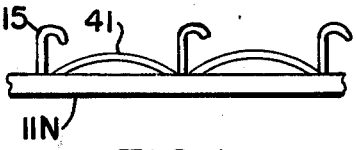
FIG. 15 is a side view of a portion of a strip-like fastening material containing both hook- and loop-like formations integrally molded with the strip material.

In FIG. 15, a molded strip 11N contains a row of fastening formations composed of hook-like molded formations 15 of the type illustrated in FIG. 3 interposed between loop-like formations 41 of the type illustrated in FIG. 12. When a plurality of the molded strips 11N have their base strip-like formations 12 edge butt or lap welded or bonded together as described, the resulting wider strip or sheet of fastening material has the ability of being secured to itself when the surfaces thereof containing the protruding, molded-on formations 15 and 41 face each other and are pushed together so that the hook-like formations 15 which protrude from one portion of the surface engage with the loop-like formations 41 protruding from the portion of the facing surface of the fastening material immediately adjacent thereto. In another form, any of the hook-like or fastening formations shown in FIGS. 2–10 and the loop-like fastening formations illustrated in FIGS. 11–14 or otherwise in this application may be combined with each other to form a composite male and female fastening material of the type illustrated in FIG. 15 which will fasten or secure to itself when the surfaces containing the fastening formations are pushed together.

Figure 16:
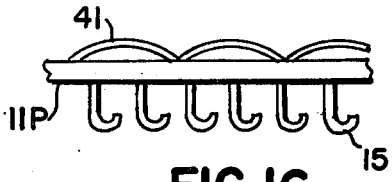
FIG. 16 is a side view of a portion of another modified form of fastening material containing loop-like formations integrally molded with the strip and protruding outwardly from one surface thereof and hook-like formations integrally molded with the protruding outwardly from the other surface thereof.

In FIG. 16, a strip-like formation 11P of fastening material contains a base strip formation 12 having molded integral with and protruding from its upper surface a plurality of loop-like formations 41 of the type illustrated in FIG. 12 while protruding from and molded integral with the other surface thereof is a row of hook-like formations 15 of the type illustrated in FIG. 3. The fastening material 11P may thus be used in applications where it is desired to fasten one side thereof to a fastening material containing a plurality of hook-like formations and the other side thereof to another fastening material containing a plurality of loop-like formations. As previously indicated, any of the male fastening formations illustrated in FIGS. 1–10 may be substituted for the hook-like elements of the strip material 11P while any of the loop-like formations illustrated in FIGS. 11–14 may be substituted for the loop-like formations 41 of FIG. 16.

Figure 17:
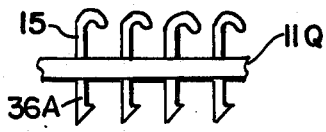
FIG. 17 is a side view of a portion of yet another form of the invention comprising a strip-like fastening material having hook-like formations integrally molded with and protruding outwardly from one face of the strip and barb-like fastening elements integrally molded with and protruding outwardly from the other face of the strip.

In FIG. 17 is shown a fastening material 11Q formed with a base strip-like portion 12 of the type described and having integrally molded and extending as a row along its upper surface a plurality of hook-like formations 15 of the type shown in FIG. 3 and a plurality of half arrowhead-like or barb-like formations 36A molded as a longitudinal row integral with and protruding downwardly from the lower surface of the base strip 12. The arrowhead or barb-like formations 36A may be employed to provide a more tenacious fastening means for the strip 11Q or a multitude of such strips which are edge joined together as described, than the plurality of rows of hook-like formations 15 for those fastening functions where it is desired to secure the fastening material to a base containing loop-like formations wherein the fastening material will not easily be removed from such base when another fastening material containing loop-like formations is pulled off the surface thereof containing the hook-like formations 15.

Figure 18:
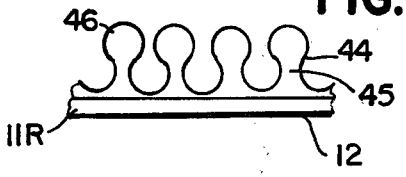
FIG. 18 is a side view of a portion of a modified form of fastening material containing bulbous fastening formations integrally molded with and protruding from a face thereof.

In FIG. 18, a fastening material 11R is composed of a strip-like base 12 containing molded integral therewith a row of fastening formations 44 each having a necked down base portion 45 which is molded integral with and extends to the upper surface of the strip-like formation 12 and extends upwardly to a bulbous formation 46 which is molded at the upper end of 45. The configurations of the bulbous formations 46 and the neck formations 45 from which they upwardly extend are such that a strip of similar fastening material or the same material formed of a plurality of such strip-like formations 11R which are bonded or welded together as described, will become frictionally secured to each other when the bulbous formations 46 of one strip nest between and beneath the bulbous formations of the adjacent strip. In other words, the outwardly flared bottom portion of each bulbous formation 46 engages the outwardly flared bottom portions of adjacent bulbous formations of the material or strip-portion against which they are compressed to effect frictional retention of the two fastenmaterials together until they are pulled apart. The fastening formations 44 of the strip-like material 11R may be continuously or intermittently molded integral with the base strip-like element 12 by one or more molding processes to be described.

Figure 19:
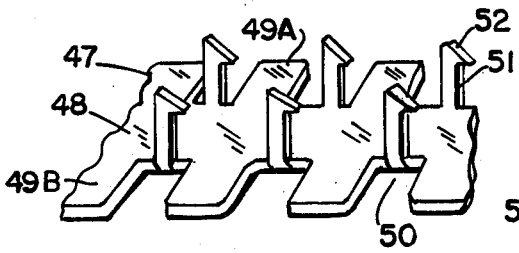
FIG. 19 is an isometric view of a portion of a fastening material formed by stamping and bending plastic or metal.

In FIG. 19 is shown a strip-like fastening material 47 which may be formed from a strip of metal or plastic which is stamped between dies so as to die cut and form a plurality of elongated fastening elements 51 having barb-like end portions 52 and extending as respective rows thereof in lateral dirctions, after which the fastening elements or formations 51 are bent, as illustrated, to provide them at substantially right angles to the upper surface of the strip. The resulting strip-like fastening material contains a plurality of tab-like formations 49A and 49B extending respectively toward opposite lateral edges of the strip and defining spaced-apart indentations 50 between tab-like formations. The narrow central portion 48 of the strip between the fastening formations 51 defines the main support for the strip and may vary from about 1/16"–¼" in width depending on the requirements for fastening. A plurality of the strip-like fastening elements 47 may be edge secured together by having the edges of the tab-like formations 49A and 49B butt or lap welded to those of similar adjacent strip-like elements or otherwise secured thereto.

Figure 20:
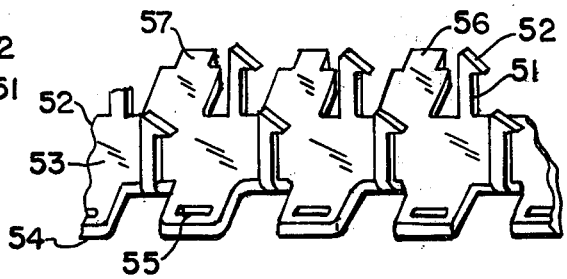
FIG. 20 is a side view of a portion of yet another form of fastening material formed by stamping or bending metal and contaning lateral formations which may be used to hingedly join similar strip-like materials to each other to provide flexible arrays of strips of fastening elements.

In FIG. 20, a strip-like fastening material 52, somewhat similar in configuration to the material of FIG. 19, is formed with tube rows of upstanding fastening formations 51 having barb-like or arrowhead end portions 52 as described and respective edge tab formations denoted 54 and 56 running along opposite longitudinal edges of the strip-like formation. The tab-like formations 54 each contain an elongated slotted opening 55 extending parallel to the longitudinal axis of the strip while the tab-like formations 56 each contain narrower extensions 57 of the tabs which may be bent at right angles to the tab and inserted through slotted openings 55 of adjacent tab formations 54 of an adjacent similarly shaped strip-like formations and then bent backwardly so as to provide means for hingedly assemblying a plurality of strip-like formations of the type illustrated to form a flexible wider sheet thereof.

In a modified form of the fastening materials 47 and 52 of FIGS. 19 and 20, it is noted that the barb-like formations 51 may alternately protrude upwardly and downwardly from each strip or one row thereof may protrude upwardly while the other protrudes downwardly so that the resulting strip or assembly of similar strips as described, may be used to fasten two articles together such as separate boards or sheets of wood or plastic materials by disposing such fastening material between the two and compressing the two together such as by means of the blows of a hammer of other means.

Suitable plastic resins of which the molded strip-like fastening materials of FIGS. 1–18 may be made include polyamides, acetyl, polycarbonates, and other so called engineering plastics of suitable strength to perform the desired fastening functions. The strip-like materials of FIGS. 19 and 20 may be die stamped from sheets of such resins or sheet metal such as suitable stainless steel or other metal.

I claim:

1. A fastening material comprising:

a plurality of separately formed strips of fastening material with each of said strips formed of plastic resin and having a strip-like planar base portion defining a unitary molding and containing a row of fastening elements extending longitudinally along the strip and protruding outwardly from one face of said strip-like base portion wherein said fastening elements have a laterally extending portion located above the strip-like base portion, said base portion being wider than the width of said fastening elements, each of said strips having its strip-like base portion in abutment along the longitudinal border portions thereof with respective longitudinal border portions of the strip-like base portions of adjacent strips whereby the fastening elements of all of said strips extend in the same direction and said rows thereof are parallel to each other, fusion bonding means securing said abutted base portions of said strips together along their abutting longitudinal border portions to provide an integral assembly of said strips which assembly defines a wider strip or sheet formation having a plurality of rows of said fastening elements extending parallel to each other across said assembly from the same side of and longitudinally along said wider formation of said material.

2. A fastening material in accordance with Claim 1 wherein said strip-like base portions of said strips are edgewise secured together by welding and provide a surface defined by a multitude of said fastening elements protruding from a sheet-like base formed of said strip-like base portions and arranged in said rows thereof.

3. A fastening material in accordance with claim 2 wherein said welding comprises a plurality of butt welds between respective abutted edge portions of said strips and extending longitudinally along said welded strip formation.

4. A fastening material in accordance with Claim 2 wherein said welding comprises a plurality of lap welds between the abutted edge portions of the strips.

5. A fastening assembly in accordance with Claim 1 wherein said strips are molded of a plastic resin capable of being ultrasonically butt welded and said strip-like base portions of said strips are edgewise ultrasonically welded together.

6. A fastening assembly in accordance with Claim 1 wherein said fastening elements each comprises a hook-like formation.

7. A fastening material in accordance with Claim 1 wherein said fastening elements each comprises a formation with at least one molded barb-like formation provided therein.

8. A fastening material in accordance with Claim 1 wherein said fastening elements each comprise a loop-like filamentary formation protruding outwardly from the strip-like base portion of the strip.

9. A fastening material in accordance with Claim 1 wherein each of said strips and its row of fastening elements is molded of a plastic resin and is flexible along its length and wherein the wider strip or sheet formed of said abutted and secured strips is also flexible along its length.

* * * * *